US005538154A

United States Patent [19]

Von Holdt

[11] Patent Number: 5,538,154

[45] Date of Patent: Jul. 23, 1996

[54] SNAP-ON, FLEXIBLE LID

[76] Inventor: John W. Von Holdt, 6864 Lexington La., Niles, Ill. 60648

[21] Appl. No.: 76,443

[22] Filed: Jun. 14, 1993

[51] Int. Cl.[6] ..... B65D 43/06; B65D 43/10

[52] U.S. Cl. ..... 220/277; 220/306

[58] Field of Search ..... 220/266, 277, 220/306, 323

[56] References Cited

U.S. PATENT DOCUMENTS

| | | | |
|---|---|---|---|
| 3,688,942 | 9/1972 | Mitchell et al. | 220/306 |
| 4,165,018 | 8/1979 | Giggard | 220/284 |
| 4,177,930 | 12/1979 | Crisci | 220/284 |
| 4,421,244 | 12/1983 | Van Melle | 220/306 |
| 4,476,993 | 10/1984 | Krout | 220/276 |
| 4,718,571 | 1/1988 | Bordner | 220/270 |
| 4,966,302 | 10/1990 | Hjordie | 220/306 |
| 5,271,517 | 12/1993 | Bowers | 220/276 |
| 5,294,015 | 3/1994 | Landis | 220/306 |
| 5,381,918 | 1/1995 | Dahl | 220/256 |

*Primary Examiner*—Stephen P. Garbe
*Attorney, Agent, or Firm*—Banner & Allegretti, Ltd.

[57] ABSTRACT

A snap-on flexible lid for a container comprises a flat lid face and an annular, peripheral flange extending normally of the lid face to enclose and grip an annular lip of a container. The term "annular" is intended to include all closed loops, for example those of rectangular containers. The flange comprises spaced panels angled inwardly from the remainder of the flange to engage the underside of the container lip. This promotes retention of the lid on the container and permits a container where the flange is essentially free of circumferential tear lines, avoiding problems of lid pop-off, and undesired tearing of the circumferential tear lines in the event the container is dropped. The angled panels are defined between pairs of cutting apertures to permit the separation of the sections defining the panels by a pair of vertical cuts, for opening of the container.

10 Claims, 4 Drawing Sheets

FIG.1
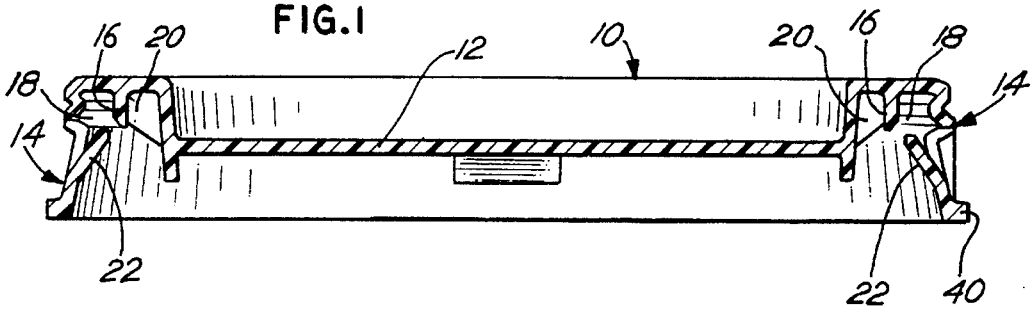
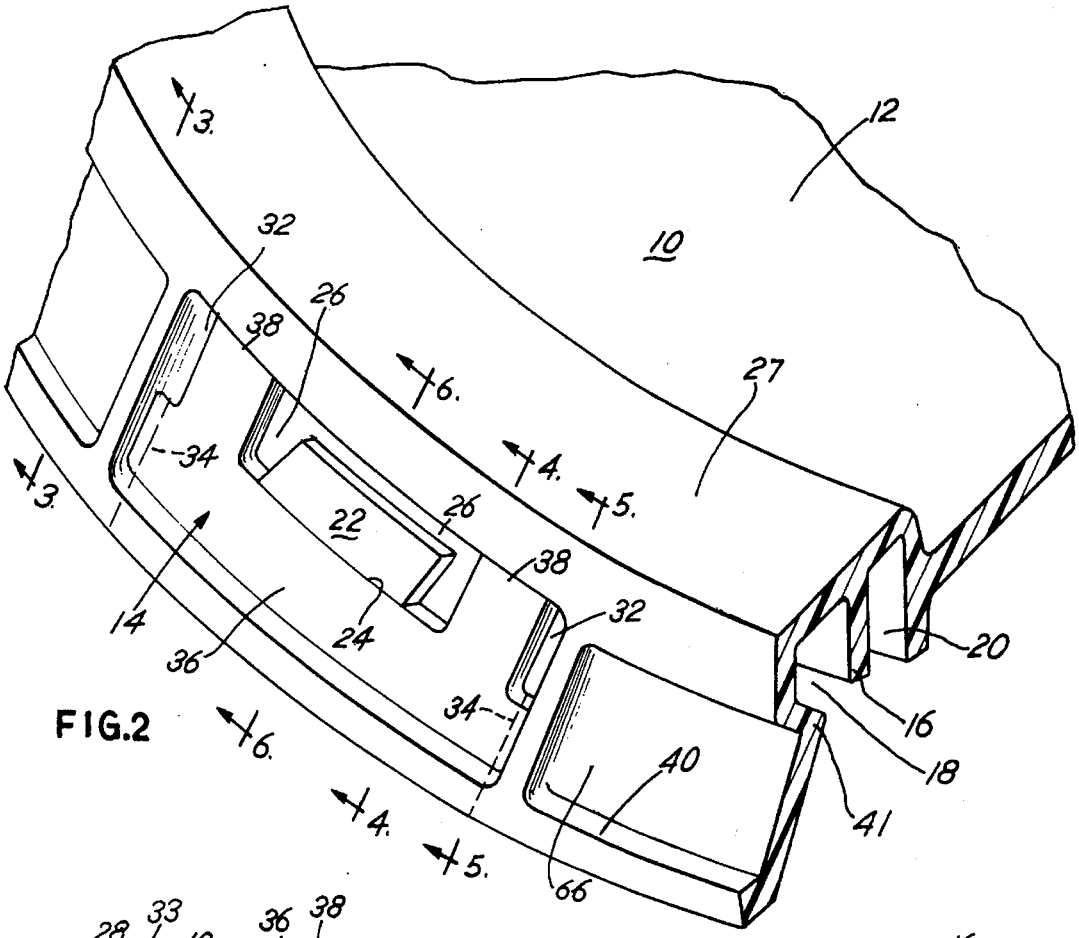
FIG.2
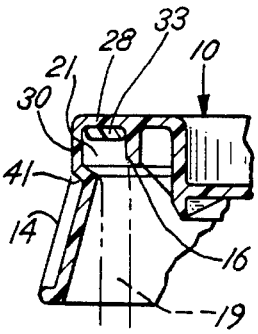
FIG.3
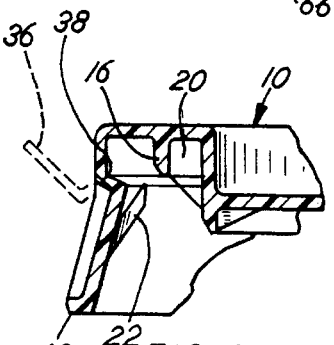
FIG.4
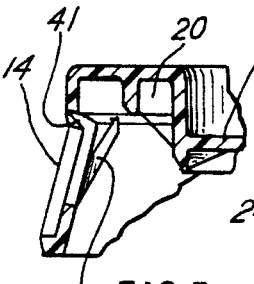
FIG.5
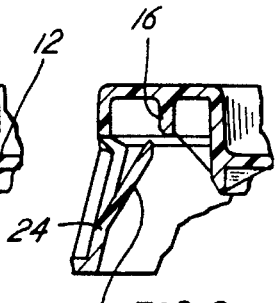
FIG.6

FIG.8
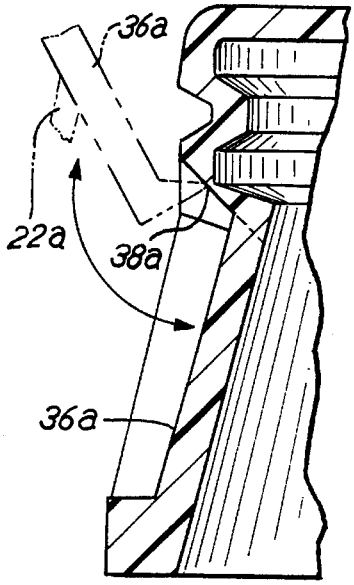
FIG.7
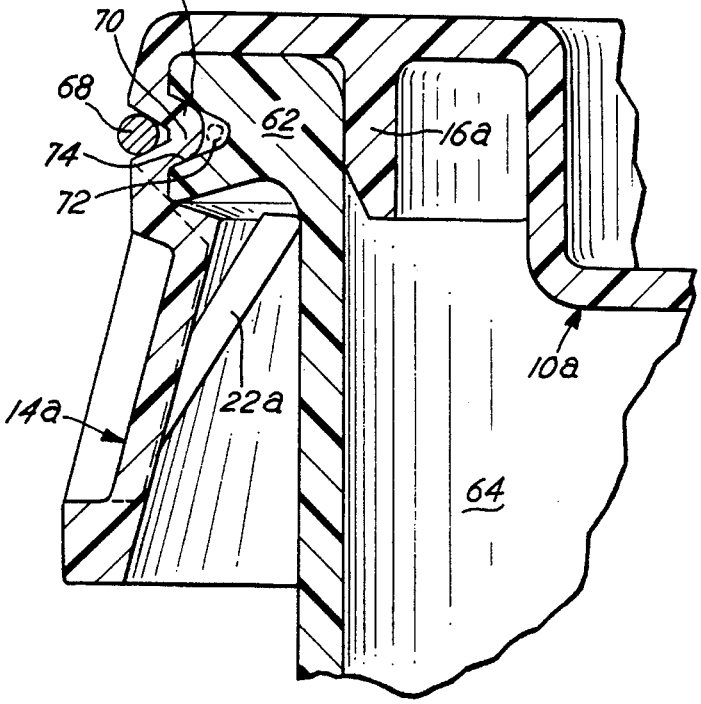
FIG.9
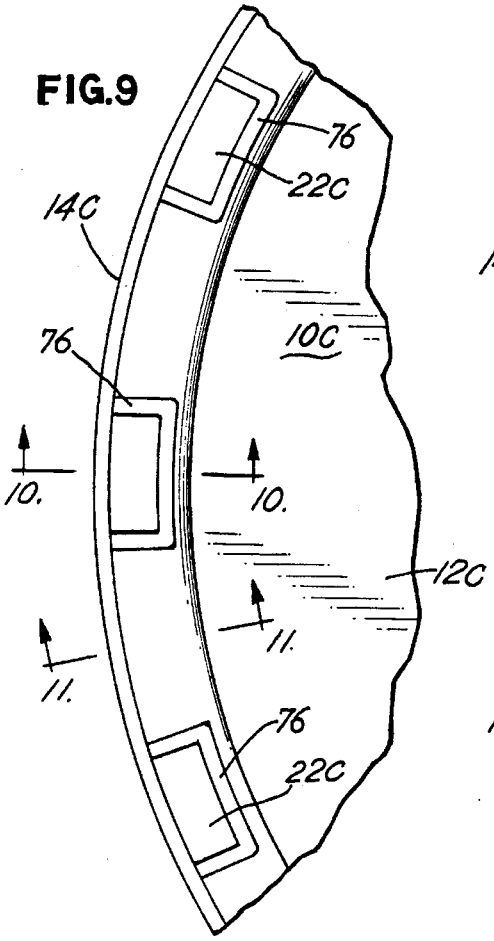
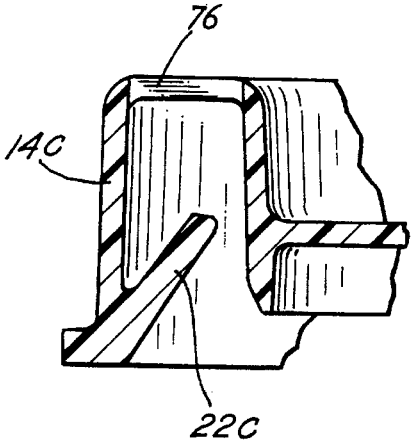
FIG.10
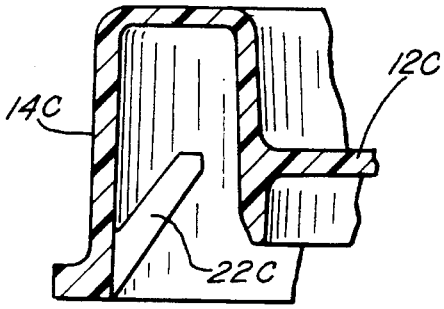
FIG.11

FIG. 12
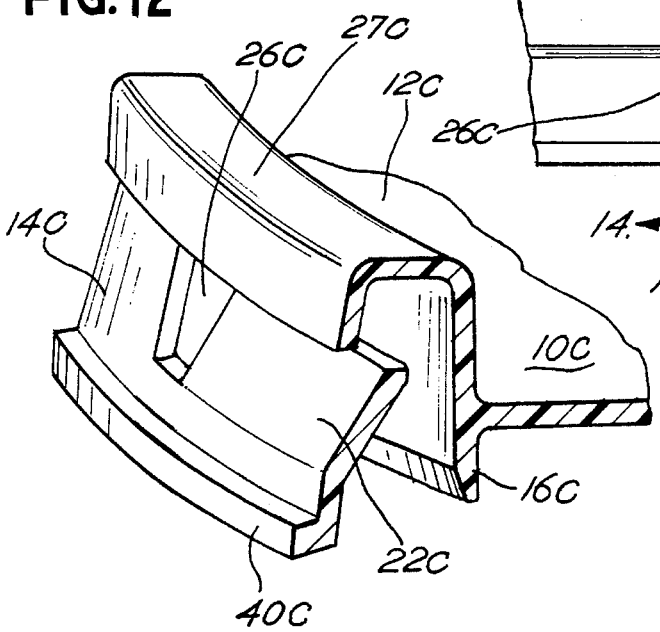
FIG. 13
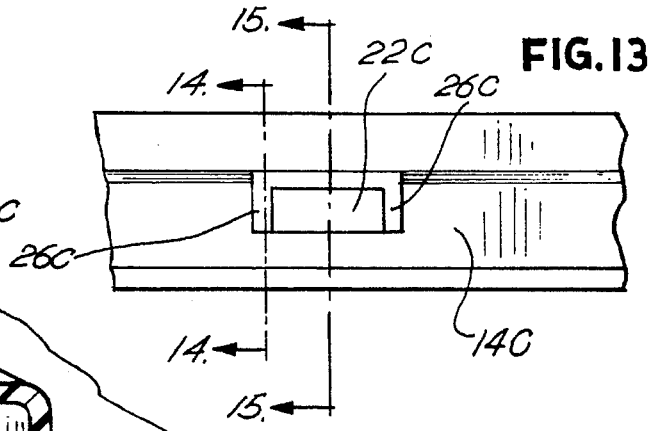
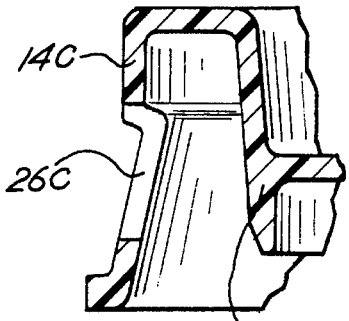
FIG. 14
FIG. 16
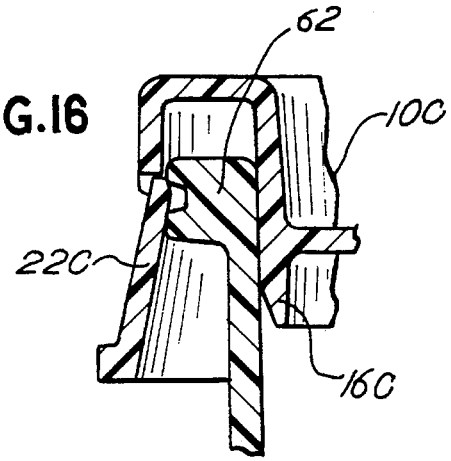
FIG. 15
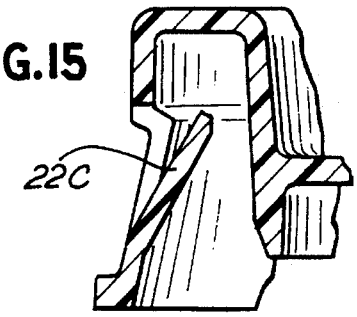
FIG. 17
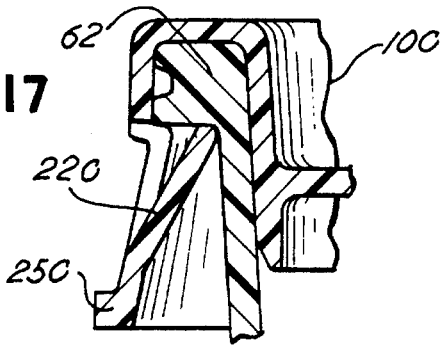
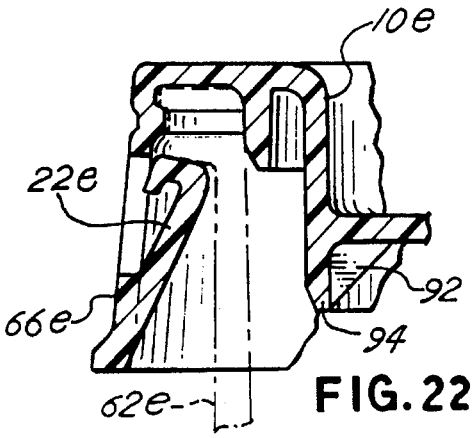
FIG. 22

FIG.18
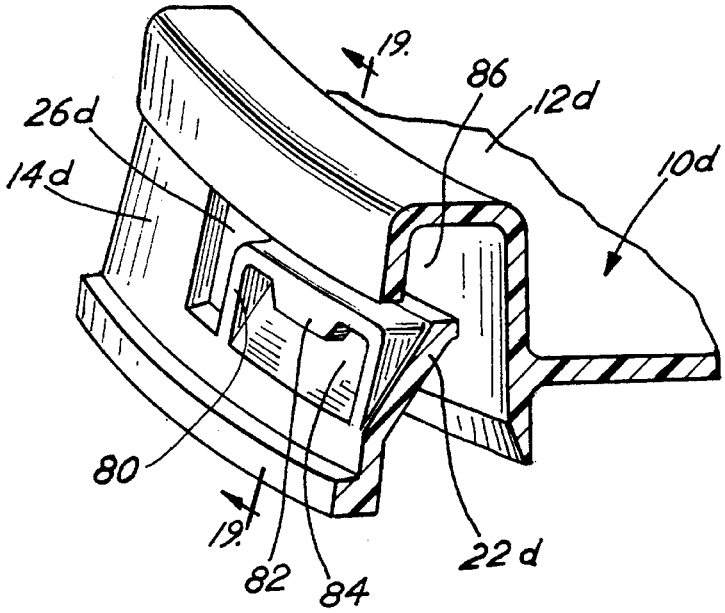
FIG.19
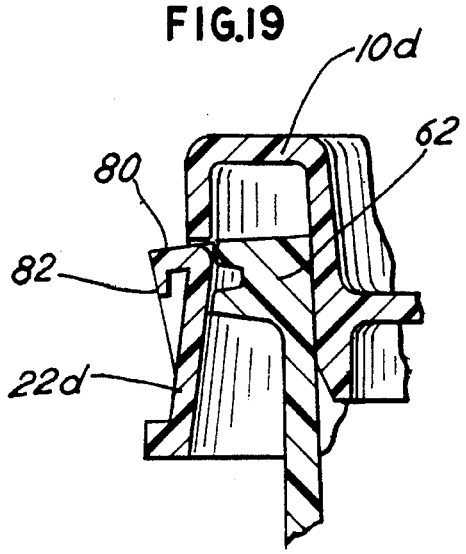
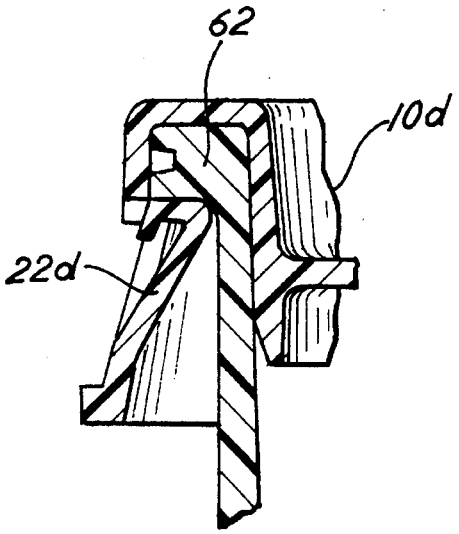
FIG.20
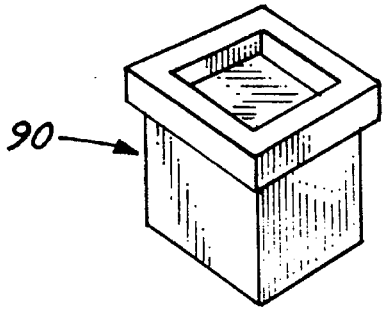
FIG.21

SNAP-ON, FLEXIBLE LID

BACKGROUND OF THE INVENTION

Plastic lids for large containers are of course well known and in extensive use. However, one limitation to their use is the tendency for the plastic lids, being somewhat flexible, to pop off of a container when it is dropped. This is especially a problem in containers of the size of half a gallon or more, so that, at the present time, plastic lids for large containers are usually retained in place with a wire ring about the periphery thereof. This of course contributes significantly to the cost of the container and inconvenience of use.

Another solution for the problem of pop-off of plastic lids when containers are dropped is illustrated in Bordner U.S. Pat. No. 4,718,571. There, a lower portion of the skirt of the lid is folded upwardly into engagement with the lip of the container. The system is removed by the tearing of circumferential "parting groove" or line of weakness 60 (FIG. 4A).

However, it has been found that when a larger container of about a half gallon or more is dropped, a shock wave generated in the liquid contents can strike the lid with sufficient force to break circumferential lines of tearing weakness. Thus, the Bordner design has limitations in its drop strength. Similarly, other designs which utilize circumferential tear strips, such as the design of Von Holdt U.S. Pat. No. 4,735,337, can exhibit similar limitations.

By this invention, a snap-on lid for a container, which lid is typically made of flexible plastic, may be provided with significantly increased drop strength, when compared with analogous prior art designs. Also there may be less need for an external retaining wire ring to hold the lid on the container lip. Thus, since the lid may be molded of plastic in a manner similar to other prior art lid designs at little or no increase of cost, a significant improvement and cost saving is achieved.

Nevertheless, despite the high drop strength of the lid of this invention, it can be opened with ease, typically having a level of flexibility to facilitate the manual removal thereof by people without strong hands.

DESCRIPTION OF THE INVENTION

In accordance with this invention, a snap-on, flexible lid for a container is provided which comprises a flat lid face and an annular, peripheral flange extending normally of the lid face to enclose and grip an annular lip of a container. The flange comprises a plurality of spaced panels bent inwardly from the remainder of said flange to engage the underside of the container lip, to promote retention of the lid on the container. By this invention, the flange may be essentially free of circumferentially directed tear line means.

The inwardly bent panels described above may be connected to the remainder of the flange along only a single end, so that they can be flexed outwardly, and then snap inwardly, as the lid is mounted on the container.

An annular wall typically extends normally from the flat lid face in inwardly spaced relation from the annular flange, to define an annular recess between the flange and wall which is proportioned to receive the container lip. This annular wall may preferably terminate at a point before it reaches the level of the outer ends of the inwardly bent, spaced panels. The inwardly bent, spaced panels are preferably molded in their inwardly bent position, so that they may be flexed outwardly, but tend to bend back inwardly when released from bending stress.

It is also preferred for each of the inwardly bent panels to be formed or defined in a separate section of the annular flange, with the separate sections being each defined between pairs of cutting apertures. Thus, lateral separation of the sections by vertical cutting, for example with a standard package opening knife or the like, permits removal of the lid.

After such cutting, the cut flange sections may define upper edges that are pivotally connected to the remainder of the lid so that the cut flange sections may be folded upwardly to move the angled panels out of engagement with the container lip by such folding action. This permits lid removal.

Alternatively, the flange sections which carry the panels may be only laterally connected to the remainder of the lid. In this embodiment, they may be completely removed by such vertical cutting, which takes place along lines that are transverse to the circumferential direction.

The lid of this invention, and other lids as well, may be mounted on a container with the annular, peripheral flange of the lid defining an inwardly or outwardly projecting annular seal member which sealingly engages a correspondingly outwardly or inwardly extending member in the lip of the bucket, for mating with the seal member. Typically, the annular, peripheral flange defines an inwardly projecting annular seal member and the container or bucket defines an outwardly-facing recess.

In accordance with this invention, at least one of the seal member and the annular mating member on the bucket may be coated with a printed or painted-on, resilient, annular sealing layer to serve as a gasket. This printing or painting process can take place simultaneously with the printing of labelling on the container, with the exception that, instead of printing ink, a fluid material such as latex that dries to a flexible layer is provided by an otherwise-conventional printing or painting process to one or both of the above mating portions of the lid and container. Preferably, it is applied to an outwardly facing recess in the container.

Such an annular sealing layer may have a thickness on the order of about 0.01 inch, or even less. If the annular seal member and the mating annular member of the container lip are well molded to quality tolerances, such a thin, annular sealing layer can provide excellent sealing against leakage. Such an automatic process can be of very low cost, and can eliminate the need for a rubber gasket in the container and lid system.

As another advantage of this present invention, the lids and containers of this invention may be of rectangular periphery, or circular or oval as desired.

In some preferred embodiments, the lid of this invention may have its annular, peripheral flange connected to the rest of the lid through an annular ring which occupies a plane which is spaced from and parallel to the plane of the majority of the flat lid face. Such an annular ring may define openings adjacent each of the angled panels. The purpose of the openings is to permit the withdrawal of a mold core portion that helps to define the spaced, inwardly bent panels, to substantially simplify the mold in which such a lid is made, without significant degradation of the sealing capability of such a lid. This also permits the annular, peripheral flange to be substantially aperture free.

Alternatively, the inwardly angled panels may extend inwardly from adjacent apertures which are defined in the annular, peripheral flange, through which mold core portions may extend to define the panels during the molding process.

DESCRIPTION OF DRAWINGS

In the drawings, FIG. 1 is a transverse sectional view of a molded container lid in accordance with this invention;

FIG. 2 is an enlarged, fragmentary perspective view of a portion of the periphery of the lid of FIG. 1;

FIGS. 3 through 6 are sectional views taken along correspondingly numbered section lines of FIG. 2;

FIG. 7 is an enlarged, fragmentary sectional view of a peripheral portion of another embodiment of the lid of this invention, shown emplaced on a container;

FIG. 8 is a fragmentary view similar to FIG. 7 with the container removed, showing how portions of the peripheral flange can be pivoted outwardly to cause disengagement of the inwardly angled panels;

FIG. 9 is a fragmentary plan view of a peripheral portion of another embodiment of the lid of this invention;

FIGS. 10 and 11 are sectional views taken along the section lines of the same number as found in FIG. 9;

FIG. 12 is a fragmentary, perspective view of another embodiment of the lid of this invention;

FIG. 13 is a fragmentary elevational view of the embodiment of FIG. 12;

FIGS. 14 and 15 are sectional views taken along the respective section lines of the same number as found in FIG. 13;

FIG. 16 is a fragmentary, sectional view similar to FIG. 15, but showing the lid being emplaced upon a bucket;

FIG. 17 is a sectional view similar to FIG. 16, showing the lid so emplaced on the bucket;

FIG. 18 is a fragmentary, perspective view of a peripheral portion of another embodiment of the lid of this invention;

FIG. 19 is a sectional view taken along line 19—19 through FIG. 18, showing the lid being placed on a bucket;

FIG. 20 is a sectional view similar to FIG. 19, showing the lid in its locked emplacement on the bucket; and lid and container in accordance with this invention; and FIG. 22 is a sectional view of another embodiment of the lid of this invention.

DESCRIPTION OF SPECIFIC EMBODIMENTS

Referring to FIGS. 1 through 6, an embodiment of the snap-on, flexible lid 10 of this invention is disclosed, comprising a flat lid face 12 and an annular, peripheral flange 14 extending normally of lid face 12 to enclose and grip an annular lip of a container.

The term "annular" is intended to include not only circular loops, but also other shapes such as oval or rectangular, since the invention may be applied to containers of other than round cross section.

Lid 10 also comprises annular wall 16 which extends normally from flat lid face 12 in inwardly spaced relation from annular flange 14, to define an annular recess 18 between the flange and wall which is proportioned to receive the container lip. An inner, annular recess 20 is also defined, which may contain a plurality of radial ribs if desired, in any desired pattern to adjust the flexibility and strength of that section of lid 10.

In accordance with this invention, annular peripheral flange 14 defines a plurality of spaced panels 22 which are angled inwardly from the remainder of the flange, and which are positioned to engage the underside of the container lip, as illustrated in subsequent embodiments disclosed herein, such as FIGS. 16 and 17. Basically, as the lid 10 is applied to the container, panel 22 is momentarily pushed outwardly by the advancing container lip, with panel 22 then snapping back into its original configuration to lock lid 10 on the container. Panel 22 is spaced at least 2 mm. from annular wall 16 in its as-molded, inwardly angled position to provide space for the steel mold part that forms the structure.

Panel 22 is attached to the remainder of flange 14 at only its lower edge 24, with the natural, as-molded configuration of panel 22 being the inwardly angled configuration illustrated in FIGS. 1 and 6. Thus, panel 22 may flex outwardly, but will naturally snap again inwardly when allowed to do so. Flange 14 preferably defines an annular, thickened reinforcing section 40 at its lower, free end for providing hoop strength.

Typically, a lid will carry two to six inwardly extending panels 22, typically equidistantly spaced about the periphery of the lid. In the embodiment of FIGS. 1–6, panel 22 is surrounded on three sides by a side aperture 26, which facilitates the molding of the structure.

Raised, annular ring 27 connects flange 14 to flat lid face 12. Ring 27 occupies a plane that is parallel to but spaced from the plane of lid face 12.

The sealing of lid 10 on container 19 (FIG. 3) can be accomplished by an annular seal between wall 16 and the container lip 21, top annular area 28 of the lid and the container lip 21, and annular, outer area 30 of lid 10 which may seal against container lip 21. Also, a rubber sealing ring 33 may be provided to the system to facilitate the seal.

It can be seen from FIGS. 16 and 17 how a lid similar to the design of lid 10 can be permanently locked onto a container by the locking action of panels 22. To remove lid 10, one merely has to make vertical cuts with a knife or the like from cutting apertures 26 or 32. One makes a vertical cut on each side of each panel 22, to form vertical cuts such as those illustrated by lines 34. Then, it becomes possible to rotate the portion 36 of flange 14 which has been isolated by the cutting lines 34, to cause portion 36 to pivot outwardly along a thinned line of bending weakness 38, as illustrated in FIG. 4. This bending, of course, takes panel 22 with it out of engagement with the lip of bucket 19. Also, the hoop strength of lid 10 is significantly weakened, since the annular lower reinforcing portion 40 is broken and correspondingly weakened by the cutting, which permits the manual removal of flexible lid 10, typically by a peeling action.

If the vertical cutting is at apertures 26, panels 22 are completely cut away from lid 10 to also permit lid opening.

If desired, annular indentation 41 (FIG. 2) may be eliminated so that the annular wall of flange 14 is flatter and straighter, for example per FIG. 22, eliminating indentations 66.

Thus, a flexible plastic lid is provided which has an extremely high drop resistance, and which will not pop off of even a large, filled container upon dropping. At the same time, the lid is readily removed from its container as described above, and can be readily returned to the container to provide a measure of sealing thereof. The pivoted portion 38 may be pivoted around again to bring panels 22 back into engagement with the lip of bucket 19 for reclosing of the bucket.

Referring to FIGS. 7 and 8, another, related embodiment of the lid of this invention is disclosed, being similar in design and function to the previous embodiment except as otherwise indicated.

Lid 10*a* is shown in FIG. 7 to be carried on the lip 62 of bucket 64. Lid 10*a* defines an annular, peripheral flange 14*a*, similar to that of the previous embodiment. FIG. 7 is a sectional view analogous to a section taken through recessed portion 66 of the FIG. 2 embodiment, FIG. 8 shows how a portion 36*a* of flange 14*a* may be vertically cut and pivoted outwardly, as in the previous embodiment, to displace angled panel 22*a*.

Annular wall 16*a* is provided for a function similar to wall 16 in the previous embodiment.

If desired, but not necessarily, an annular sealing wire 68 can fit in a recess defined by inwardly projecting annular seal member 70, defined in lid 10*a*, and sealingly received in annular, outwardly-facing mating recess 72 of bucket lip 62. In accordance with this invention, the sealing can be greatly enhanced by the presence of an annular coating 74 of a printed-on or painted-on, resilient, annular sealing layer 74 to serve as a gasket. Such a sealing layer may be an elastomeric latex, which may be applied to either inwardly projecting annular seal member 70 or outwardly facing annular recess 72 by a conventional printing or painting process, particularly at the time that bucket 64 has its labelling applied by a printing process. It is preferable for recess 72 to receive the annular sealing layer 74 in such a process. Thus, an effective elastomeric seal is applied between the lid and container without the need of a separate, added rubber ring or the like. Significant cost savings can be achieved in this manner. Typically, sealing layer 74 may have a thickness of about 0.002 to 0.05 inch, for example about 0.01 inch.

Alternatively or additionally, an elastomeric sealing ring may occupy recess 72, for effective sealing against flange 14*a* of the lid.

Referring to FIGS. 9 through 11, another design of container lid is disclosed which is similar to the lid of FIGS. 1–6 except as otherwise indicated herein.

Lid 10*c* defines a similar flat lid face 12*c* and annular, peripheral flange 14*c*, similar to the corresponding parts of the previous embodiments. In this embodiment, the respective inwardly extending, spaced panels 22*c* are integrally molded with annular peripheral flange 14*c*, as before, but with each panel 22*c* being associated with an upper aperture 76, which is provided to permit portions of the mold to form panel 22*c* without the presence of side apertures in annular flange 14*c*. As before, cutting apertures may be defined to bracket each inwardly extending panel 22*c*, to facilitate upward pivoting of panels 22*c*, or otherwise the total removal thereof, by vertical cuts on either side of the panels.

Referring to FIGS. 12 through 15, another embodiment of the flexible lid of this invention is disclosed, being similar to the embodiment of FIGS. 1 through 6 except as otherwise described.

As shown, lid 10*c* defines a flat lid face 12*c* and an annular, peripheral flange 14*c* extending normally of the lid face and adapted to enclose and grip the annular lip of a container. Angled panels 22*c*, of similar structure and function to the embodiment of FIGS. 1 through 6, are shown. The bottom of flange 14*c* defines an annular reinforcing rib 40*c* to strengthen the flange until rib 40*c* is cut for opening of the lid.

As before, panel 22*c* may be bracketed by cutting apertures 26*c*, permitting removal of panel 22*c*.

In this embodiment, inner, annular wall 16*c* is provided as before, connecting to annular ring 27*c* which occupies a plane which is spaced from and parallel to the plane of flat lid face 10*c*, but of somewhat different design from the embodiment of FIGS. 1 through 6.

Referring to FIGS. 16 and 17, the emplacement of lid 10*c* onto a bucket rim 62 is shown. FIG. 16 shows how the lid lowers onto bucket rim 62 to cause panels 22*c* to displace outwardly by pivoting. Then, as shown in FIG. 17, panels 22*c* snap back into their original configuration as lid 10*c* is fully seated on the bucket rim. Thus, lid 10*c* is permanently mounted on the bucket until panels 22*c* are cut away through use of respective cutting apertures 26*c*, or other cutting apertures analogous to apertures 32 as previously described.

Referring to FIGS. 18 through 20, another, related lid design is shown which is similar to the design of FIGS. 12 through 17 except as otherwise disclosed herein. Lid 10*d* comprises flat lid face 12*d* and annular peripheral flange 14*d*, as in the previous embodiments. Inwardly bent panel 22*d* is also provided for a function similar to the previous embodiments. However, in this embodiment, panel 22*d* carries, integrally molded therewith, an outwardly facing bracket 80 which defines a projecting tab 82.

Cutting apertures 26*d* are also provided on either side of each panel 22*d*.

The purpose of bracket 80 and projecting tab 82 is to facilitate removal of the lid from the mold. The portion of the mold which occupies and defines recess 84 of bracket 80 may, at the completion of the molding process be pulled laterally outwardly, to pull bracket 80 and tab 22*d* with it. This gets the newly formed panel 22*d* out of the way of the mold portion which defines recess 86, to facilitate separation of the mold parts and removal of the newly formed lid. Upon release, panel 22*d* snaps back into its desired position, in a mode of action which is similar to its action shown in FIGS. 19 and 20, showing how lid 10*d* is placed upon the lip 62 of a bucket in a manner similar to previous embodiments.

Thus, as is the case with previous embodiments, lid 10*d* becomes permanently mounted on bucket lip 62 until panels 22*d* are cut away by vertical severing of the lower portion of flange 14d beginning at apertures 26*d*.

FIG. 21 shows a rectangular lid and container 90, which may be of a design of any of the previous embodiments.

FIG. 22 shows another enlarged, sectional view of a lid 10*e* which may be similar in structure and function to the previously disclosed lids except as otherwise described herein.

In particular, lid 10*e* resembles lid 10 of FIGS. 1–6, except that front wall 66*e* is straight in lid 10*e* without a recess as provided by annular inward angle 41 in the embodiment of FIGS. 1–6.

Angled panels 22*e* are of a design and function which may be similar to angled panels 22*d*. A lip of a container 62*e* can force panels 22*e* outwardly as the lid is seated on the container, with panels 22*e* snapping again inwardly for retention thereof as before. A plurality of radial fins 92 may be provided for added rigidity in the area of inner annular wall 94.

Lid 10*e* may have auxiliary sealing means of any of the types previously described herein.

The lid of this invention may be molded and flexible, but it exhibits very strong resistance to popping off of a large container or prematurely tearing when the container is dropped. Also, the lid is tamperproof in that the cutting provides clear evidence that the container has been opened, and yet the container exhibits excellent sealing characteristics for volatile contents.

The above has been offered for illustrative purposes only, and is not intended to limit the scope of the invention of this application, which is defined in the claims below.

That which is claimed is:

1. A plastic snap-on flexible lid for mounting on a top of a plastic container of the type having an annular rim which projects radially outwardly, said lid comprising, in combination, a top lid face, an annular peripheral flange, an inner annular wall spaced inwardly from said flange, said flange and said annular inner wall defining a downwardly facing annular recess to receive said annular rim on said top of said lid, said flange and said annular wall being generally upright, said flange including a plurality of spaced, flexible panels which are each connected to said flange only at a bottom edge of said panel and which extend upwardly and inwardly from said bottom edge, said flexible panels being deflected outwardly when said lid is initially forced down on said top of said container and springing back to radially inward positions to lock under said rim when said lid is forced fully down on said top of said container, and an aperture formed in said flange on each side of each of a plurality of said spaced panels, each said aperture being for the purpose of permitting entry of a cutting instrument to permit cutting down from said aperture to a lower edge of said flange to permit removal of said spaced panels and thereby facilitate removal of said lid, said flange being essentially free of a circumferential tear line.

2. A plastic snap-on flexible lid as defined in claim 1 including a plurality of hingedly mounted flange sections, each said flange section having one of said panels connected thereto along a lower edge of said panel, each said flange section having an upper edge where it is connected to an upper portion of said flange, said upper edge of said flange section defining a hinge line between said flange section and said upper portion of said flange, and an additional pair of apertures formed in said flange with one on each side of each said flange section, each said additional aperture being for the purpose of permitting entry of a cutting instrument to permit cutting down from said additional aperture to said lower edge of said flange to permit said flange section to be pivoted outwardly and upwardly about said hinge line to move said spaced panels to release positions and thereby facilitate removal of said lid.

3. A plastic snap-on flexible lid as defined in claim 2 where on the inside of said flange there is formed an annular inwardly projecting ledge which is positioned to lock under said rim when said lid is forced fully down on said top of said container, said ledge being interrupted in locations where one of said panels is present, and said ledge remaining in locked position under said rim after said panels have been moved to release positions.

4. A plastic snap-on flexible lid as defined in claim 1 where said peripheral flange includes a radially outward facing annular groove near the upper end thereof, and an annular sealing wire located in said groove.

5. A plastic snap-on flexible lid as defined in claim 4 where on the inside of said flange there is formed an annular inwardly projecting ledge which is positioned to lock under said rim when said lid is forced fully down on said top of said container, said ledge being interrupted in locations where one of said panels is present, and said ledge remaining in locked position under said rim after said panels have been moved to release positions.

6. A plastic snap-on flexible lid as defined in claim 4 where said flange is formed to have a radially inwardly projecting annular seal member located adjacent said annular groove, and said annular rim has an annular rim groove which receives said annular seal member when said lid is forced fully down on said top of said container.

7. A plastic snap-on flexible lid as defined in claim 6 where on the inside of said flange there is formed an annular inwardly projecting ledge which is positioned to lock under said rim when said lid is forced fully down on said top of said container, said ledge being interrupted in locations where one of said panels is present, and said ledge remaining in locked position under said rim after said panels have been moved to release positions.

8. A plastic snap-on flexible lid as defined in claim 6 where an annular sealing ring is located in said annular rim groove radially inwardly of said annular seal member.

9. A plastic snap-on flexible lid as defined in claim 8 where on the inside of said flange there is formed an annular inwardly projecting ledge which is positioned to lock under said rim when said lid is forced fully down on said top of said container, said ledge being interrupted in locations where one of said panels is present, and said ledge remaining in locked position under said rim after said panels have been moved to release positions.

10. A plastic snap-on flexible lid as defined in claim 1 where on the inside of said flange there is formed an annular inwardly projecting ledge which is positioned to lock under said rim when said lid is forced fully down on said top of said container, said ledge being interrupted in locations where one of said panels is present, and said ledge remaining in locked position under said rim after said panels have been moved to release positions.

* * * * *